US006997748B1

(12) United States Patent
Su

(10) Patent No.: US 6,997,748 B1
(45) Date of Patent: Feb. 14, 2006

(54) SHIELDED SHELL FOR ELECTRONIC CONNECTOR

(75) Inventor: Chia Sheng Su, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 11/072,286

(22) Filed: Mar. 7, 2005

(51) Int. Cl.
*H01R 13/648* (2006.01)

(52) U.S. Cl. ..... 439/607; 439/609

(58) Field of Classification Search ..... 439/607–610, 439/570, 573, 566, 101, 108, 92, 95, 701
See application file for complete search history.

(56) References Cited

U.S. PATENT DOCUMENTS 4,678,121 A * 7/1987 Douty et al. ..... 439/610
4,913,664 A * 4/1990 Dixon et al. ..... 439/607
5,122,480 A * 6/1992 Galich et al. ..... 29/838
5,171,167 A * 12/1992 Kosmala ..... 439/607
5,580,268 A * 12/1996 Miyazawa ..... 439/352
5,735,699 A * 4/1998 Tan et al. ..... 439/92
6,000,968 A * 12/1999 Hagiwara ..... 439/607
6,019,616 A * 2/2000 Yagi et al. ..... 439/108
6,193,554 B1 * 2/2001 Wu ..... 439/607
6,280,209 B1 * 8/2001 Bassler et al. ..... 439/101
6,290,540 B1 * 9/2001 Nishio et al. ..... 439/607
6,346,009 B1 * 2/2002 Lin ..... 439/607
6,371,810 B1 * 4/2002 Iwasaki ..... 439/607
6,764,338 B1 * 7/2004 Fang ..... 439/607
6,827,610 B1 * 12/2004 Lin ..... 439/607
2003/0224656 A1 * 12/2003 Yoshida ..... 439/578
2004/0266265 A1 * 12/2004 Hayashi ..... 439/609

* cited by examiner

*Primary Examiner*—Alexander Gilman
(74) *Attorney, Agent, or Firm*—Rosenberg, Klein & Lee

(57) ABSTRACT

The present invention provides a shielded shell for an electronic connector. The shielded shell comprises an exterior shielded body and an interior shielded body which is received in the exterior shielded body and receives an insulating body with terminals. There is a plurality of elastic slices formed on the interior shielded body, and a plurality of holes provided in the exterior shielded body to receive the free ends of the elastic slices of the interior shielded body. An engaging hole is formed at each board extending from each lateral side of the exterior shielded body. A plurality of tabs is formed on a back panel of the exterior shielded body; a block is projected from the tab to engage with the engaging hole. Therefore, the two-layered shielded shell provides a reinforced force in order to engage with a connector firmly.

2 Claims, 4 Drawing Sheets

SHIELDED SHELL FOR ELECTRONIC CONNECTOR

BACKGROUND OF THE INVENTION

1. Field of the Invention

The invention relates to a shielded shell, and more especially to a shielded shell for an electronic connector, which is provided with an interior shielded body and an exterior shielded body reliable and steady engaging with the connector.

2. The Related Art

Conventional electronic connector has an insulating body, which receives a plurality of terminals and is enclosed with a shielded shell. The shielded shell is made of thin metal board and latched with the insulating body by conventional latching structure. A plurality of elastic slices is set at the top surface, bottom surface and two lateral surfaces of the shielded shell. The elastic slices prop the shielded shell of the mated connector when the electronic connector mates with the mated connector, so that the fixation function between the two connectors is obtained.

The electronic connector for transmitting power usually has the structure as illustrated above. In general, the power connector needs a reliable and steady mechanical and electronic connection in order to provide a steady signal transmission, so that a biggish inserting and pulling force is required. The power connector only has one shielded body, so the intensity is weak. When the power connector mates with the mated connector, a biggish inserting force is generated. The latching structure of the shielded shell is released from the plastic casing due to the deformation of the shielded shell.

SUMMARY OF THE INVENTION

An object of the invention is to provide a shielded shell for an electronic connector. The shielded shell comprises an interior shielded body and an exterior shielded body. The interior shielded body has a plurality of elastic slices. The exterior shielded body has a plurality of holes to receive the free ends of the elastic slices of the interior shielded body. Therefore, the two-layered shielded shell provides a reinforced force in order to engage with a connector firmly.

A further object of the invention is to provide a shielded shell which has a tab extending from a back panel of the exterior shielded body. A block is projected from the tab. A board extending from lateral side of the exterior shielded body has an engaging hole to engage with the block. So that the exterior shielded body is firmly engaged with the interior shielded body.

DETAIDED DESCRIPTION OF THE PREFREED EMBODIMENT

The present invention will now be described with respect to the accompanying drawings in which like numbered elements represent like parts.

Figure 1:
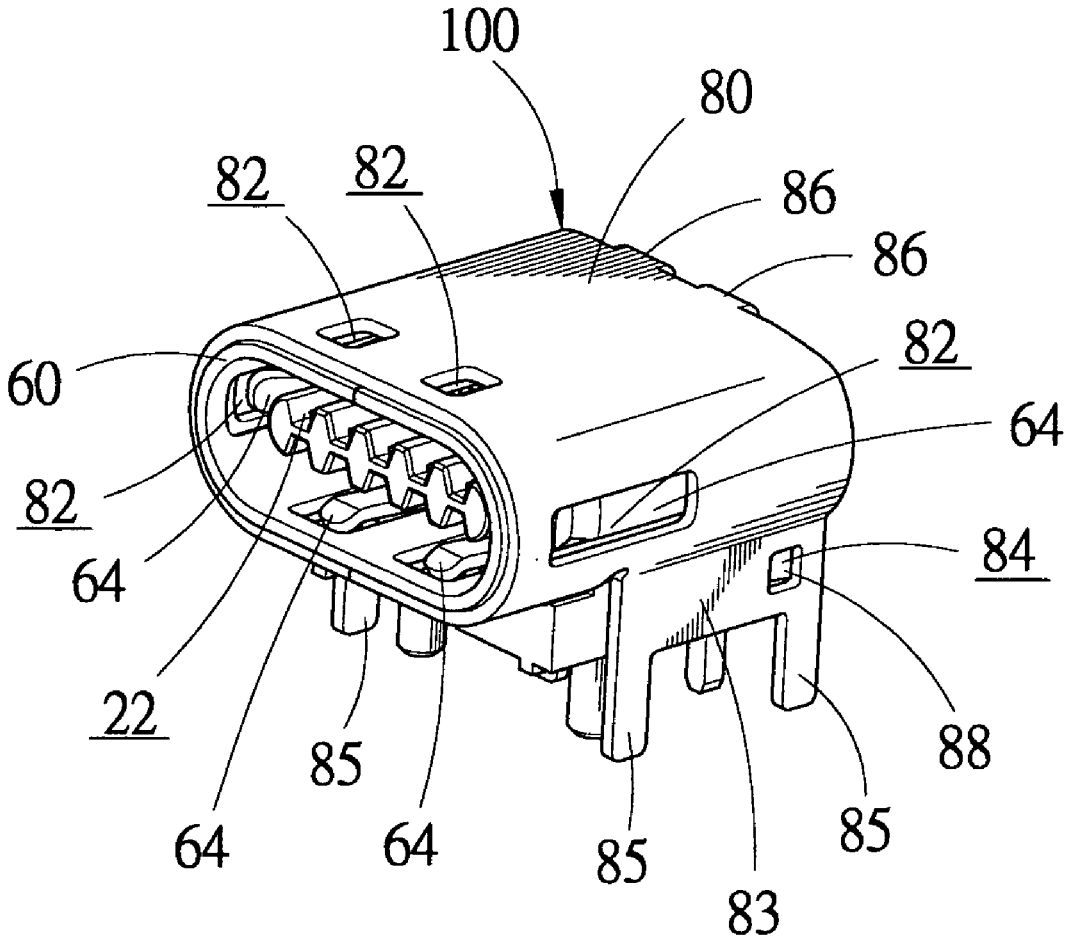
FIG. 1 is a perspective view of a connector in accordance with the present invention.
Figure 2:
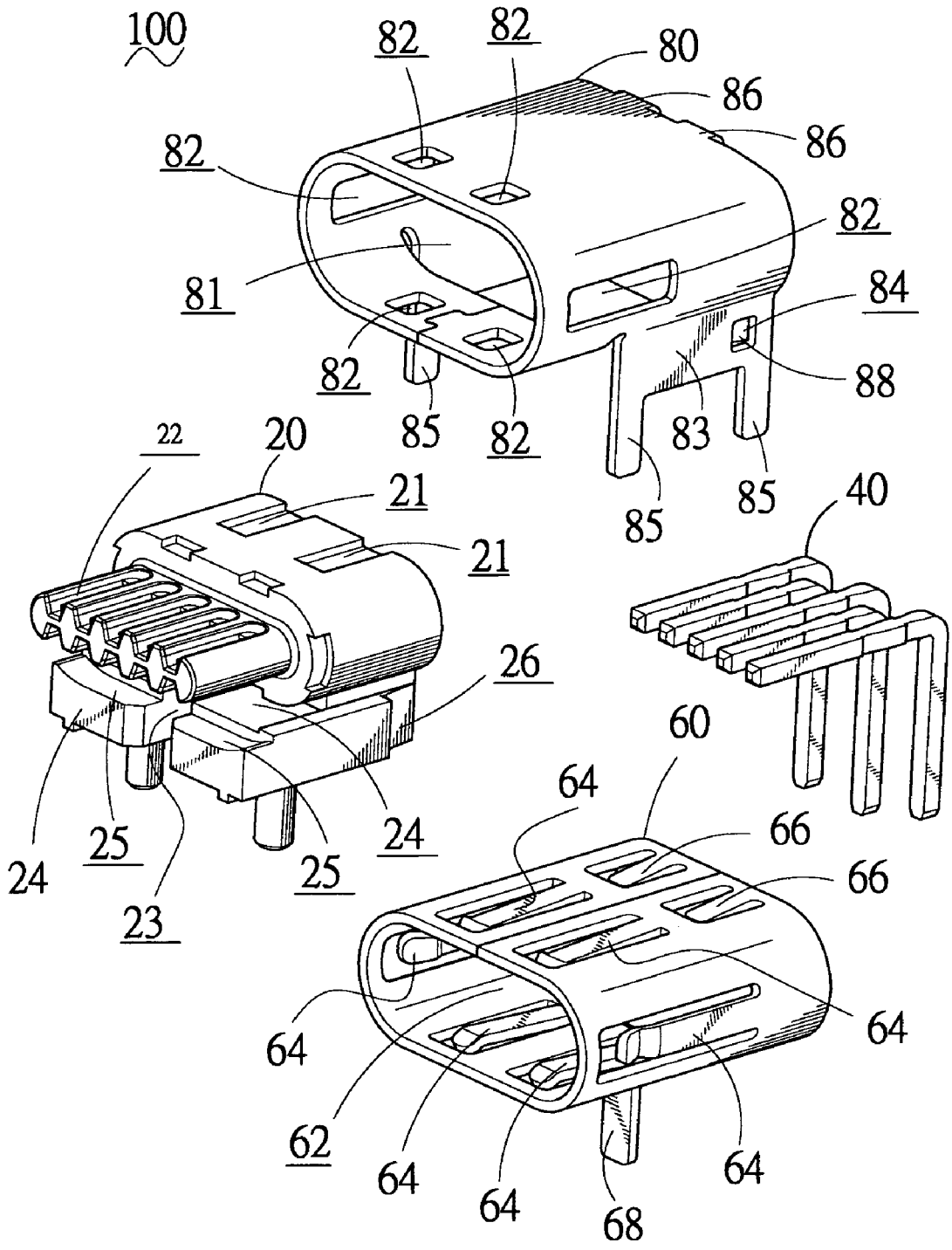
FIG. 2 is an exploded perspective view of the connector in accordance with the present invention.

With reference to FIGS. 1 and 2, a connector 100 of the present invention comprises a plurality of terminals 40, an insulating body 20 into which the terminals 40 insert and a shielded shell which includes an interior shielded body 60 for receiving the insulating body 20 and an exterior shielded body 80 enclosing the interior shielded body 60.

Figure 3:
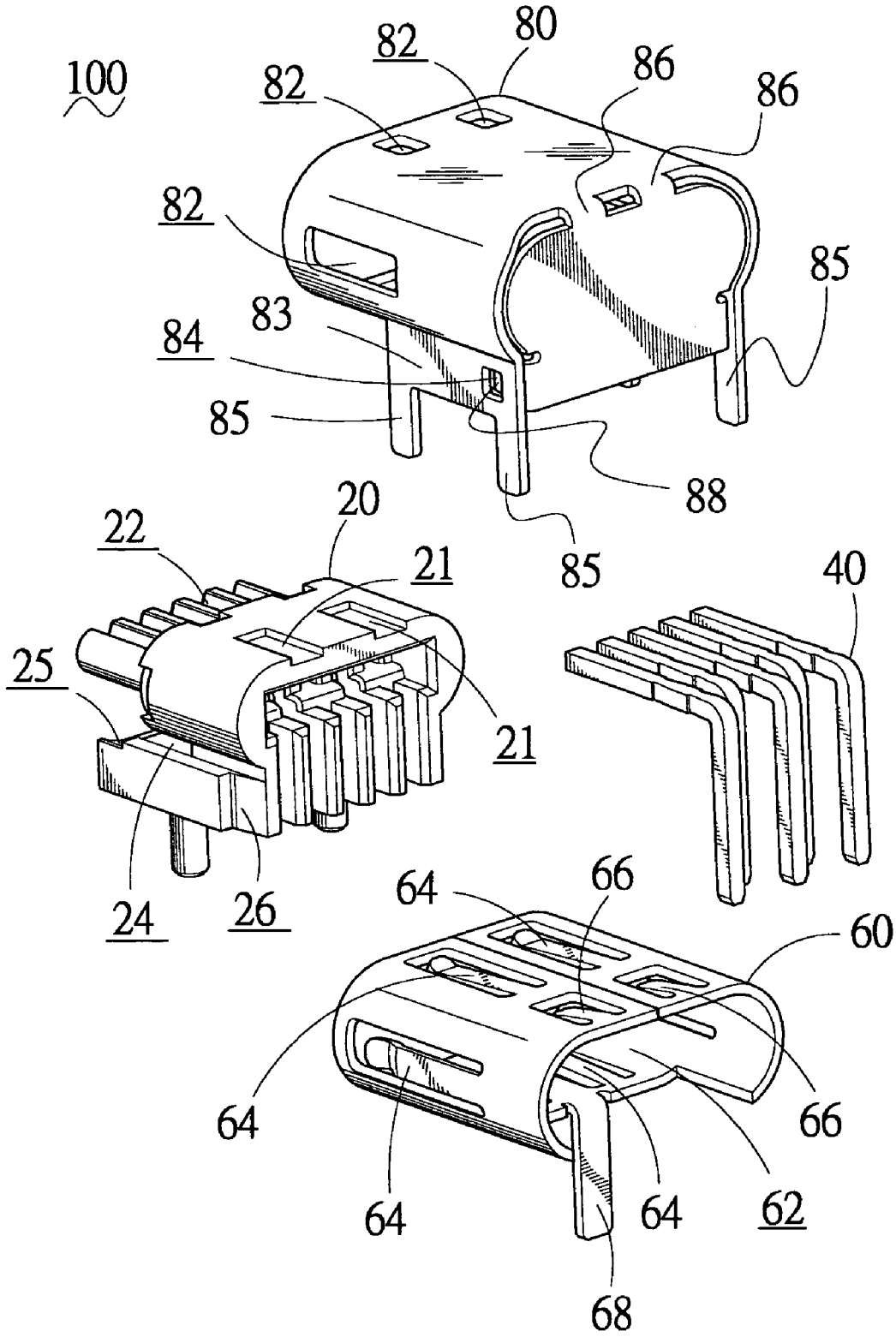
FIG. 3 is an exploded perspective view of the connector viewing form rear side.
Figure 4:
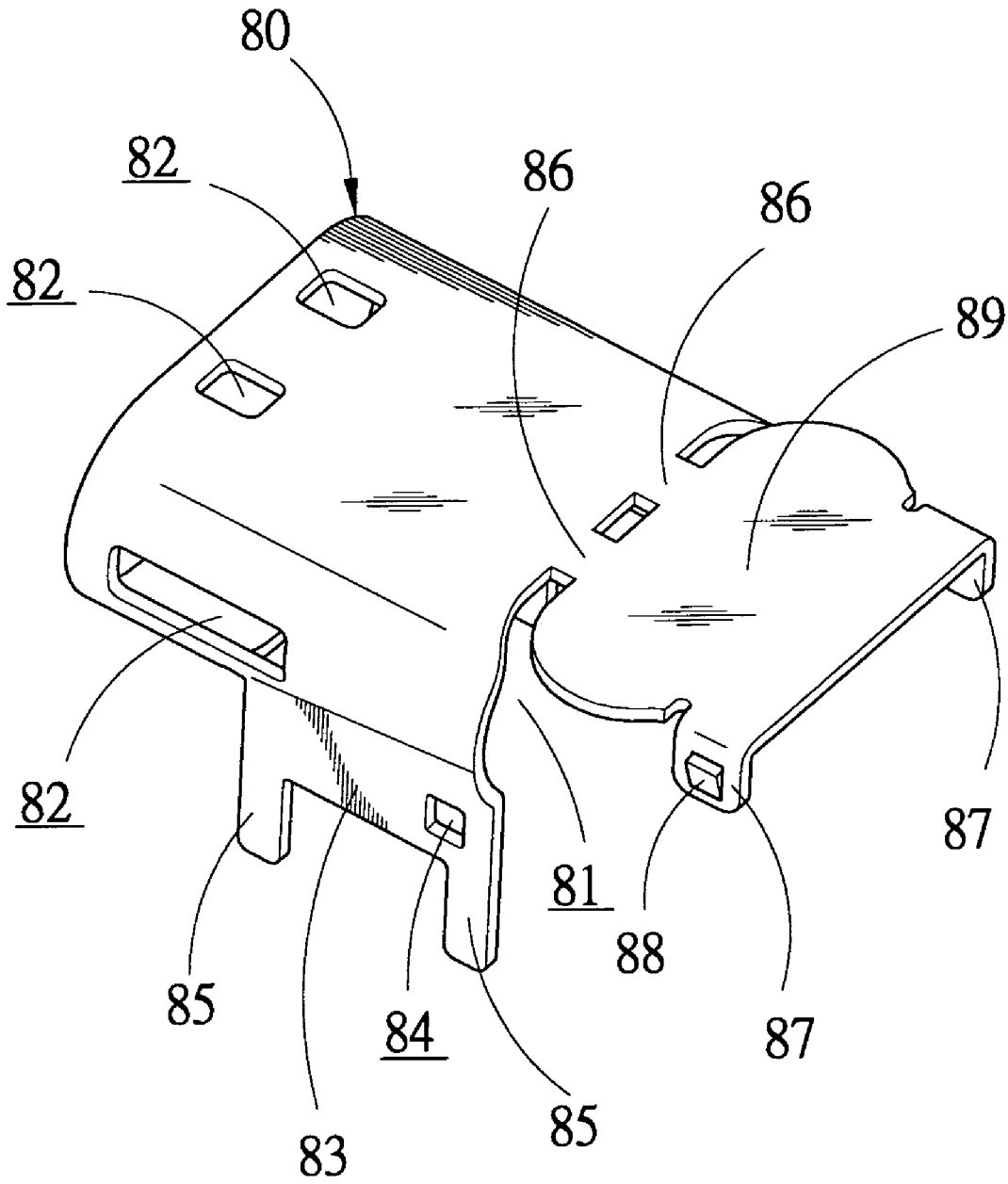
FIG. 4 is a perspective view showing an exterior shielded body of the shielded body before assembly.

Referring to FIGS. 2 and 3, the insulating body 20 has a plurality of recesses 21 formed at the top side of the insulating body 20. A plurality of slots 22 is provided in top side of the insulating body 20 to dispose the terminals 40 therein. A first slot 23 is vertically formed at front side of the insulating body 20. A second slot 24 and a third slot 25 are parallel to each other and horizontally formed at the front side of the insulating body 20. A notch 26 is formed at each lateral side of the insulating body 20 to fix the exterior shielded body 80.

The interior shielded body 60 is a hollow body so that a space 62 is formed in the interior shielded body 60. A plurality of elastic slices 64 is formed at the front of the top and bottom sides of the interior shielded body 60. A plurality of positioning slices 66 is formed at the back of the top side of the interior shielded body 60, which is corresponding to the elastic slices 64 and extends to the space 62. Each of the positioning slices 66 is positioned in the respective recess 21 so that the interior shielded body 60 cannot slide ahead out of the insulating body 20. A pillar 68 downwardly extends from the back edge of the bottom side of the interior shielded body 60. The pillar 68 and the bottom side of the interior shielded body 60 are respectively disposed in the first slot 23 and the second slot 24 of the insulating body 20 so that the interior shielded body 60 can not slide backwardly out of the insulating body 20. A plurality of elastic slices 64 is formed at the lateral sides of the interior shielded body 60. The elastic slices 64 formed at the lateral sides of the interior shielded body 60 are longer than the elastic slices 64 formed at the top and bottom sides of the interior shielded body 60. All free ends of the elastic slices 64 downwardly extend to the space 62 to connect with a shielded body of a mated connector (not shown) and then upwardly extend.

With reference to FIGS. 1 to 4, the shape of the exterior shielded body 80 is corresponding to the interior shielded body 60. The exterior shielded body 80 is also a hollow body to form a holding space 81. The holding space 81 receives the interior shielded body 60. The exterior shielded body 80 receives the interior shielded body 60 with the back side of the exterior shielded body 80 closed. A plurality of holes 82 is provided in the top, bottom and lateral sides of the exterior shielded body 80 corresponding to the free ends of the elastic slices 64 of the interior shielded body 60. The free end of the elastic slice 64 is received in the hole 82 respectively in order to provide an engagement of the interior shielded body 60 and the exterior shielded body 80. A board 83 extends from each lateral side of the exterior shielded body 80. An engaging hole 84 is formed at each board 83. A plurality of pins 85 extends from the front and back of the bottom edge of the board 83 to fix the shielded body 100 of the present invention on a printed circuit board (not shown). The back panel 89 of the exterior shielded body 80 connects with the top side of the exterior shielded body 80 through a pair of slices 86. Before assembly, the back panel 89 is parallel to the top side of the exterior shielded body 80 (shown in FIG. 4). The back panel 89 has a plurality of tabs 87 vertically extending from the rear end of the back panel 89. Each of the tabs 87 has a block 88 outwardly projected from the tab 87. After assembly, the back panel 89 is downwardly bent (shown in FIG. 3). Each of the pins 85 is located in the notch 26 of the insulating body 20. Each of the blocks 88 inserts into the respective engaging hole 84 of the board 83.

In the embodiment described above, the blocks 88 of the exterior shielded body 80 are disposed in the engaging holes 84 of the lateral sides of the exterior shielded body 80. Accordingly, the exterior shielded body 80 is in a stable and reliable condition. The exterior shielded body 80 encloses the interior shielded body 60 tightly so that the whole shielded body connects with the mated connector stably.

As illustrated above, the shielded shell comprising an interior shielded body 60 and an exterior shielded body 80 receives the insulating body 20 which disposes a plurality of terminals 40 therein. The shielded shell has two layers to provide a reinforced force of the shielded shell, so a stable and reliable engagement of the connector and the shielded shell is achieved.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A shielded shell comprising an exterior shielded body and an interior shielded body which is received in the exterior shielded body and receives an insulating body with terminals, wherein the interior shielded body has a plurality of elastic slices formed on the interior shielded body, a plurality of positioning slices formed at the top side of the interior shielded body and a pillar downwardly extending from the back edge of the bottom side of the interior shielded body; and the exterior shielded body has a plurality of holes provided in the exterior shielded body to receive the free ends of the elastic slices of the interior shielded body, a board extending from each lateral side of the exterior shielded body, an engaging hole formed at each board, a plurality of pins extending from the front and back of the bottom edge of the board to connect to a printed circuit board, a plurality of tabs formed on a back panel of the exterior shielded body, a block projected from the tab to engage with the engaging hole.

2. The shielded shell as claimed in claim 1, wherein the elastic slices are formed on the top, bottom and lateral sides of the interior shielded body, the holes are provided in the top, bottom and lateral sides of the exterior shielded body.

* * * * *